US008292421B2

(12) United States Patent
Mandel et al.

(10) Patent No.: US 8,292,421 B2
(45) Date of Patent: Oct. 23, 2012

(54) MEDIA HOLD-DOWN DEVICE USING TENSIONED THIN GUIDES

(75) Inventors: Barry Paul Mandel, Fairport, NY (US); Ruddy Castillo, Briarwood, NY (US)

(73) Assignee: Xerox Corporation, Norwalk, CT (US)

( * ) Notice: Subject to any disclaimer, the term of this patent is extended or adjusted under 35 U.S.C. 154(b) by 359 days.

(21) Appl. No.: 12/389,023

(22) Filed: Feb. 19, 2009

(65) Prior Publication Data

US 2010/0209169 A1 Aug. 19, 2010

(51) Int. Cl.
*B41J 2/01* (2006.01)

(52) U.S. Cl. ..... 347/104; 347/101

(58) Field of Classification Search ..... 347/104, 347/101; 271/164; 400/642
See application file for complete search history.

(56) References Cited

U.S. PATENT DOCUMENTS

| | | | | | |
|---|---|---|---|---|---|
| 1,675,525 | A | * | 7/1928 | Aldrich | 271/104 |
| 2,160,906 | A | * | 6/1939 | Reinartz | 271/231 |
| 2,294,406 | A | * | 9/1942 | Huffman | 271/12 |
| 2,769,522 | A | * | 11/1956 | Pfeiffer | 198/334 |
| 2,916,286 | A | * | 12/1959 | Keating | 271/220 |
| 2,923,543 | A | * | 2/1960 | Metzner et al. | 226/81 |
| 3,272,504 | A | * | 9/1966 | Schnoebelen | 271/216 |
| 3,309,078 | A | * | 3/1967 | Nash | 271/12 |
| 3,388,905 | A | * | 6/1968 | Nash et al. | 271/13 |
| 3,802,546 | A | * | 4/1974 | Helms | 400/618 |
| 3,951,402 | A | * | 4/1976 | Skinner | 271/273 |
| 4,351,601 | A | * | 9/1982 | Cormier et al. | 399/398 |
| 4,506,879 | A | * | 3/1985 | Goodwin et al. | 271/238 |
| 4,526,358 | A | * | 7/1985 | Ura et al. | 271/34 |
| 4,673,306 | A | | 6/1987 | Rubinstein et al. | |
| 4,836,527 | A | * | 6/1989 | Wong | 271/251 |
| 4,934,687 | A | * | 6/1990 | Hayden et al. | 271/202 |
| 5,295,676 | A | * | 3/1994 | Kenin et al. | 271/94 |
| 5,574,551 | A | * | 11/1996 | Kazakoff | 399/45 |
| 5,686,950 | A | * | 11/1997 | Hirakue | 347/104 |
| 6,039,481 | A | * | 3/2000 | Ham | 400/708 |
| 6,042,106 | A | * | 3/2000 | Kelly et al. | 271/188 |
| 2001/0028380 | A1 | * | 10/2001 | Wotton et al. | 347/102 |
| 2002/0067403 | A1 | * | 6/2002 | Smith | 347/104 |
| 2003/0137573 | A1 | * | 7/2003 | Rasmussen et al. | 347/104 |
| 2003/0142190 | A1 | * | 7/2003 | Rasmussen et al. | 347/104 |
| 2003/0179273 | A1 | * | 9/2003 | Tsuji et al. | 347/104 |

FOREIGN PATENT DOCUMENTS

DE 19820959 A1 * 11/1999

* cited by examiner

*Primary Examiner* — Stephen Meier
*Assistant Examiner* — Leonard S Liang
(74) *Attorney, Agent, or Firm* — Fox Rothschild LLP

(57) ABSTRACT

A print system including a print head array configured to print ink onto a printable medium, a transport surface positioned adjacent to the print head array and configured to transport a printable medium past the print head array and a plurality of thin guides positioned between the transport surface and the print head array, the plurality of thin guides held in tension and configured to prevent edges of a printable medium from contacting the print head array as the printable medium passes under the print head array.

19 Claims, 6 Drawing Sheets

MEDIA HOLD-DOWN DEVICE USING TENSIONED THIN GUIDES

BACKGROUND

The present invention relates to printable media guide and hold-down devices and systems. More specifically, the present invention relates to movable guides used to overlap and hold down printable media.

Direct-to-paper ink jet printing systems typically include a printable media hold-down system. As a printable medium passes on a transport surface under an ink jet print head, the hold-down system attempts to prevent contact between the printable medium and the print head. Contact between printable media and the print head may result in fibers from printable media becoming lodged in ink nozzles in the print head. Over time, a substantial number of fibers could become lodged in the nozzles causing the print head to clog. A clogged print head can damage printable media by printing incorrectly, waste ink, and cause significant downtime as the clogged head must be cleaned and/or replaced.

Some high speed printing systems, or systems for printing larger sizes of printable media, may require a large array of print heads. A clogged print head is especially troubling when using a print head array. Cleaning and/or replacing the print heads in a print head array can cause an even greater downtime depending on the size of the print head array.

Several hold-down systems are prevalent in modern direct-to-paper printing systems. One example is a vacuum/plenum system. In this system, a series of small holes are placed in the transport surface, and air is sucked through the holes, away from the print head (or print head array). As the printable medium passes under the print head (or print head array), a vacuum is created under the printable medium, thereby holding the printable medium against the transport surface.

Another exemplary hold-down system is an electrostatic tacking hold-down system. In this system, the transport surface is electrostatically charged, resulting in the printable medium tacking, or electrostatically sticking, to the transport surface as the printable medium moves under the print head (or print head array).

Both of these hold-down systems have inherent problems, however. Specifically, both systems limit the amount of force that can be applied across printable media to protect the printable media from coming into contact with the print head (or print head array). Both of these approaches are particularly susceptible to failure at the corners of printable media. At the corners, the downward force caused by the vacuum is less than at other portions of a printable medium due to air leakage around the edge of the printable medium, and force exerted by an electrostatic system decreases if the sheet edge is not in intimate contact with the transport surface. Also, at the corners, the bending moment imparted by the vacuum or the electrostatic tacking is lowest, which can result in the corners bending away from the transport surface and contacting the print head (or print head array).

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Thus, for example, reference to a "printable medium" is a reference to one or more printable media and equivalents thereof known to those skilled in the art, and so forth. Unless defined otherwise, all technical and scientific terms used herein have the same meanings as commonly understood by one of ordinary skill in the art. As used herein, the term "comprising" means "including, but not limited to."

In one general respect, the embodiments disclose a printing system. The system includes a print head array configured to print ink onto a printable medium, a transport surface positioned adjacent to the print head array and configured to transport a printable medium past the print head array and a plurality of thin guides positioned between the transport surface and the print head array, the plurality of thin guides held in tension and configured to prevent edges of a printable medium from contacting the print head array as the printable medium passes under the print head array.

In another general respect, the embodiments disclose a printing system, the system including a print head array configured to print ink onto a printable medium, a transport surface positioned adjacent to the print head array and configured to transport a printable medium past the print head array and a plurality of thin guides positioned between the transport surface and the print head array, the plurality of thin guides comprising moving guide belts configured to hold down a printable medium as the printable medium passes under the print head array.

In another general respect, the embodiments disclose a printable media hold-down system. The printable media hold-down system includes a transport surface positioned adjacent to a print head array for the purpose of transporting the printable medium past the print head array and at least one thin guide positioned between the transport surface and the print head array, wherein the at least one guide is positioned in a cross process direction to the transport surface such that the at least one thin guide overlaps at least one edge of a printable medium to prevent the printable medium from contacting the print head array.

BRIEF DESCRIPTION OF THE DRAWINGS

Aspects, features, benefits and advantages of the present invention will be apparent with regard to the following description and accompanying drawings, of which.

DETAILED DESCRIPTION

For purposes of the discussion below a "printable medium" refers to a physical sheet of paper, plastic and/or other suitable substrate for printing images thereon.

A "print head array" refers to one or more print heads configured to disperse ink onto a printable medium.

Figure 1:
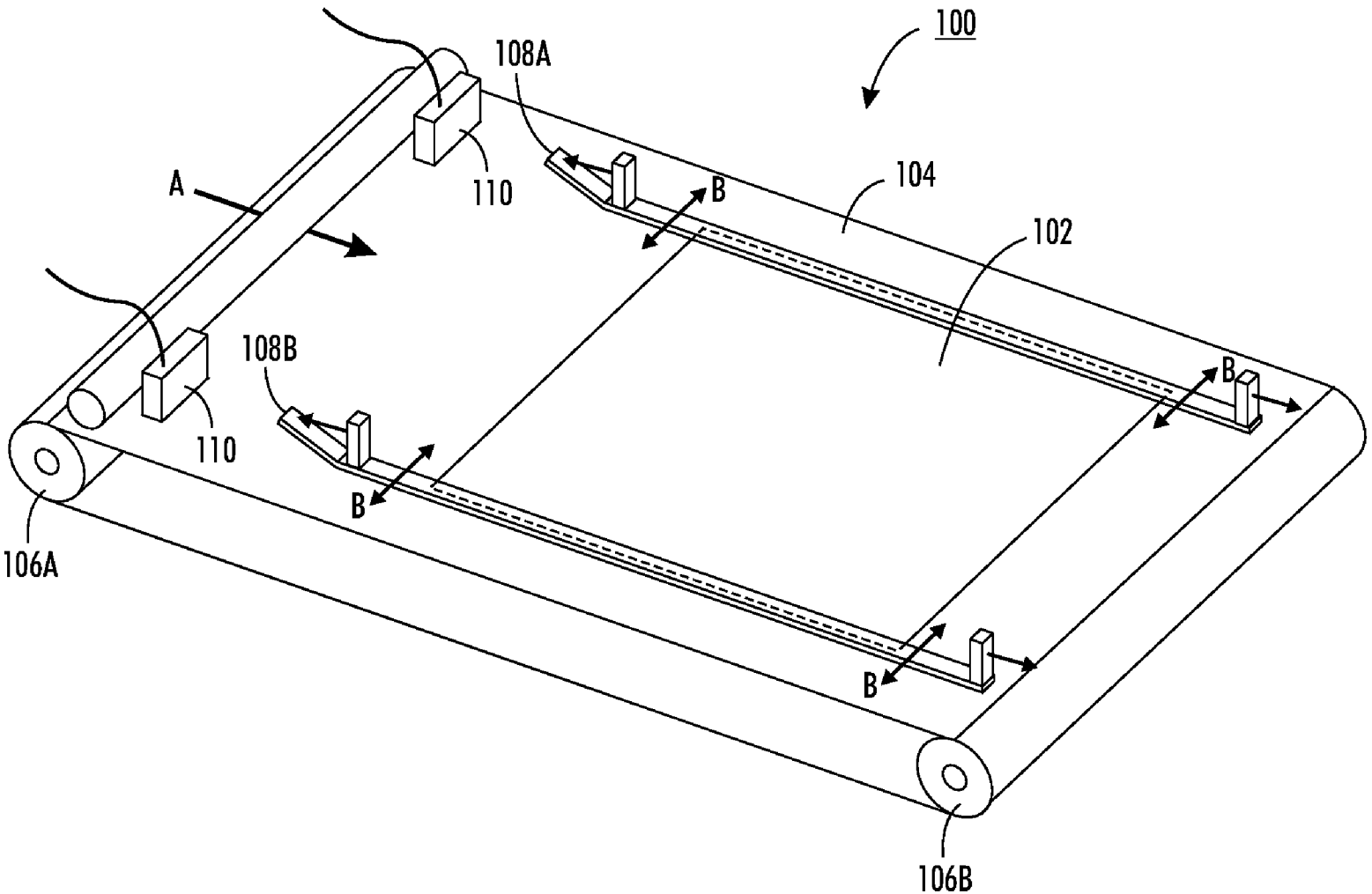
FIG. 1 illustrates various embodiments of a printable media belt transport system using thin tensioned guides.

FIG. 1 illustrates an isometric view of a printable media belt transport system 100. A printable medium 102 travels in the direction of arrow A through belt transport system under a print head array (not shown). Printable medium 102 is placed on transport surface 104. Transport surface 104 is essentially a belt that loops around two rollers, roller 106A and roller 106B. Transport surface 104 is stretched tightly over rollers 106A and 106B such that if either roller turns, the transport surface will move as well. In an exemplary system, roller 106B may be the driving roller that moves transport surface 104 while roller 106A may be used for steering (e.g., by variably tensioning the transport surface, tensioning, drive and steering systems not shown in FIG. 1). Transport surface 104 may include a vacuum/plenum system or an electrostatic system of holding printable medium 102 down flat. Vacuum/plenum systems hold-down systems will be discussed in greater detail in the discussions of FIGS. 2 and 3 below.

Additional hold-down components, tensioned thin guide 108A and tensioned thin guide 108B, are used in belt transport system 100. Tensioned thin guides 108A and 108B may be constructed from any material suitable for being made thin, while maintaining structural integrity. For example, tensioned thin guides 108A and 108B may be constructed of metal such as steel or stainless steel. Additionally, the dimensions of tensioned thin guides 108A and 108B may vary depending on the application, but for exemplary purposes, may be approximately 0.1 to 0.2 mm in thickness, and approximately 5 mm in width. By using a 5 mm width, an individual tensioned thin guide may overlap a printable medium by approximately 3 mm, which may be sufficient to ensure the edge of the printable medium is under the tensioned thin guide while not overlapping the printable medium so far as to require an overly large non-printable border. It should be noted that a separate alignment/registration process may be performed to properly align the printable medium for printing. In this example, it is assumed the printable medium has already been registered and aligned.

It is also important to note that the tensioned thin guides may fit between the printable media and the print head array. With low speed "swath", or back and forth printing systems, the print zone is a relatively small distance in the process reducing the need for tensioned thin guides. Conversely, a high speed single pass system, such as a high speed ink jetting system using staggered full width arrays of print heads, will have a longer print zone in the process direction. It may be difficult to design a rigid, non-tensioned guide and maintain any required straightness and stiffness as the material may be prone to bending and distorting. As such, the tensioned thin guides described herein are held flat and tensioned via a mounting and tensioning system that engages the tensioned thin guides at each end and maintains tension in the guides. It is important to note that the present invention may enable the print heads to be mounted closer to the print media than otherwise would be possible without risking the print media contacting the print heads. Mounting the print heads close to the media may be desirable as this may improve overall image quality due to a reduction in ink drop placement errors. The thin tensioned guide mounting system is described in more detail below in the discussions of FIGS. 2 and 3.

Tensioned thin guides 108A and 108B are positioned in a cross process direction to transport surface 104 such that they slightly overlap the edges of printable medium 102, thereby insuring the corners of the printable medium are held down away from a print head array. To compensate for different sizes of printable medium 102, tensioned thin guides 108A and 108B are movable in the directions indicated by the arrows labeled B. The repositioning of the tensioned thin guides, along with their location with respect to the print head array is discussed in greater detail in the following discussions of FIG. 2 and FIG. 3.

Figure 2:
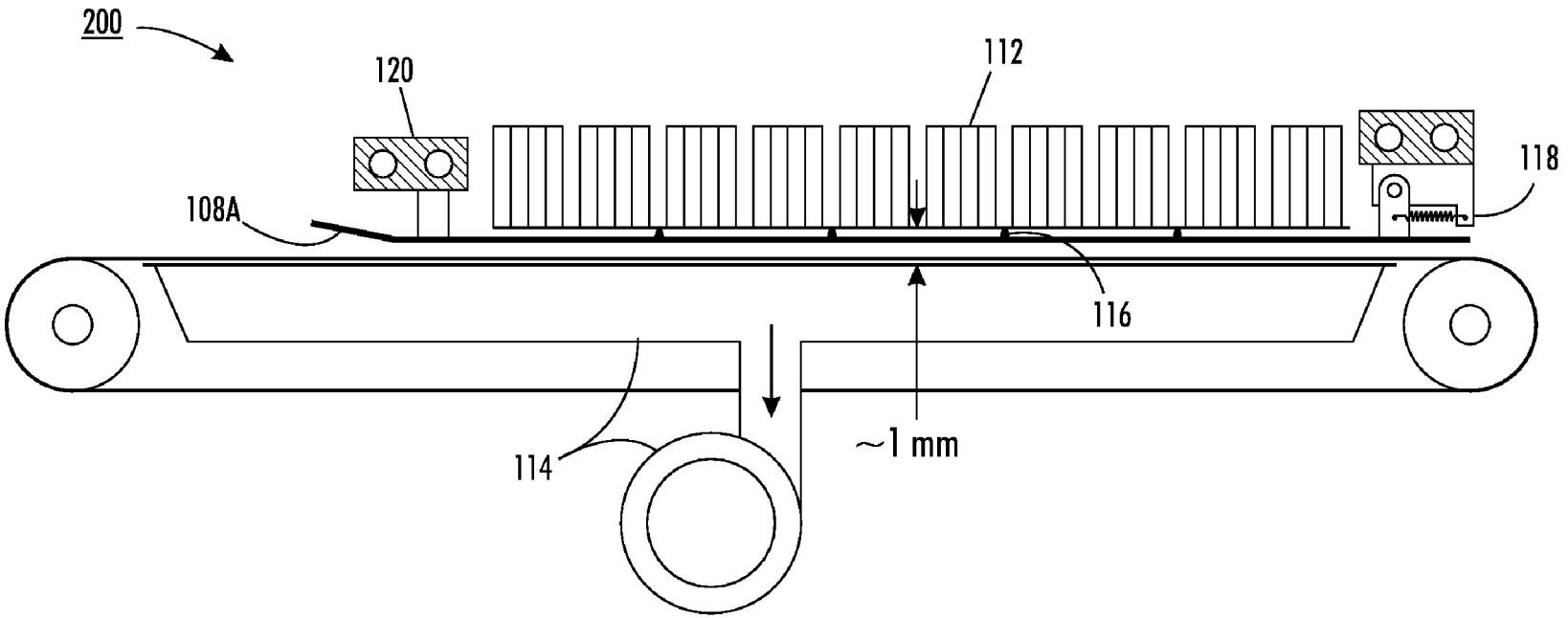
FIG. 2 illustrates various embodiments of a printing assembly including the printable media belt transport system of FIG. 1.

FIG. 2 illustrates a side view of printable media hold-down system 200 similar to media hold down system 100 as described in FIG. 1. A printable medium passes under tensioned thin guide 108A, held against the transport surface by vacuum system 114. Vacuum system 114 includes a plenum as well as a blower that, in combination, assist in holding the printable medium against the transport surface. As the printable medium passes under print head array 112 tensioned thin guides 108A and 108B (not seen in FIG. 2) hold the edges of the printable medium down and away from the ink heads of print head array 112.

The printable medium passes under the tensioned thin guides 108A and 108B, and the tensioned thin guides are tensioned by tensioning device 118, part of the mounting system discussed above. By providing a horizontal tension, a thin guide, such as 108A, may be held straight and flat, and may be able to resist the loads exerted by the printable medium. Additionally, to prevent thin guide displacement and to further protect print head array 112, a series of stand-offs 116 may be included on the tensioned thin guides 108A and 108B. Another component of the thin guide 108A or 108B may be slidable positioning device 120. As different sized printable media are passed under the print head array 112, the thin guides 108A and 108B may need to be adjusted. By including sensors 110 (shown in FIG. 1) on the transport surface 104 (also shown in FIG. 1), the size of the printable media including various dimensions such as width and length of the printable media may be determined and the thin guides 108A and 108B may be adjusted to accommodate the different sized printable media. It should be appreciated that if different size media are transported in a center registered print system (wherein the centerline of each size media is in a consistent location), then both of the tensioned thin guides may be repositioned for each sized media. However, if an edge registered system is used (wherein an outboard edge of each size media is in a consistent location), then only one of the tensioned thin guides may be repositioned.

Figure 3A:
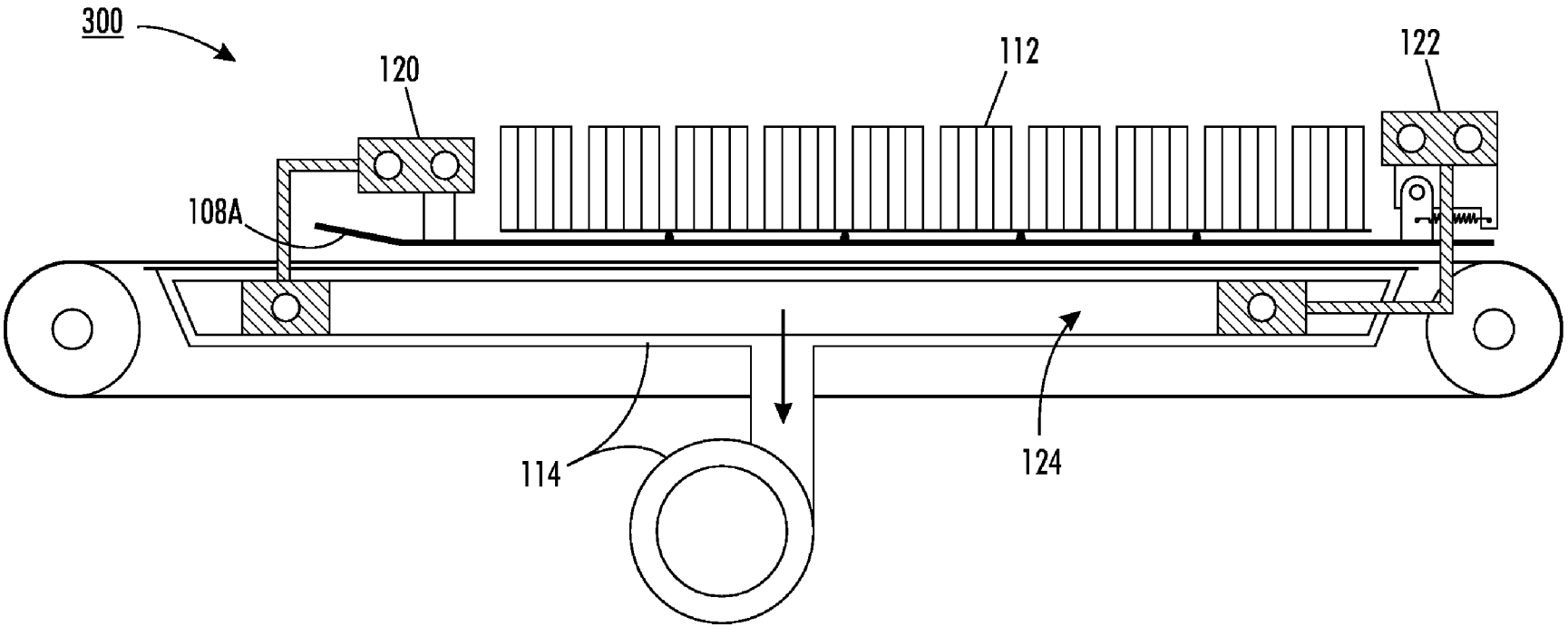
FIG. 3*a* illustrates various embodiments of a printing assembly including the printable media belt transport system of FIG. 1.

FIG. 3*a* illustrates a side view of media hold down system 300 similar to media hold down system 200 as described in FIG. 2. Like media hold down system 200 in FIG. 2, only tensioned thin guide 108A is visible in FIG. 3*a*. In this example, vacuum system 114 may include an adjustable baffle 124. Adjustable baffle 124 may be connected to thin guide 108A via adjustable connectors 120 and 122. Like media hold down system 200, thin guide 108A is adjustable based on the size of the printable media. Sensors (not shown in FIG. 3*a*) may detect the dimensions of a printable medium and activate a drive system to adjust the tensioned thin guides (e.g., tensioned thin guides 108A and 108B) to overlap the edge of the printable medium. In media hold down system 300, adjustable baffle 124 is connected to tensioned thin guide 108A such that as tensioned thin guide 108A is moved to accommodate different sized printable media, the baffle adjusts as well, thereby altering the size of the vacuum hold down area as well. In this arrangement, a common drive system may be used by both adjustable baffle 124 and tensioned thin guide 108A (or both tensioned thin guides 108A and 108B if both are adjustable). By adjusting the vacuum hold down area, media hold down system 300 reduces the requirements of vacuum system 114 by eliminating wasted vacuum suction on areas of the transport surface not handling printable media.

Figure 3B:
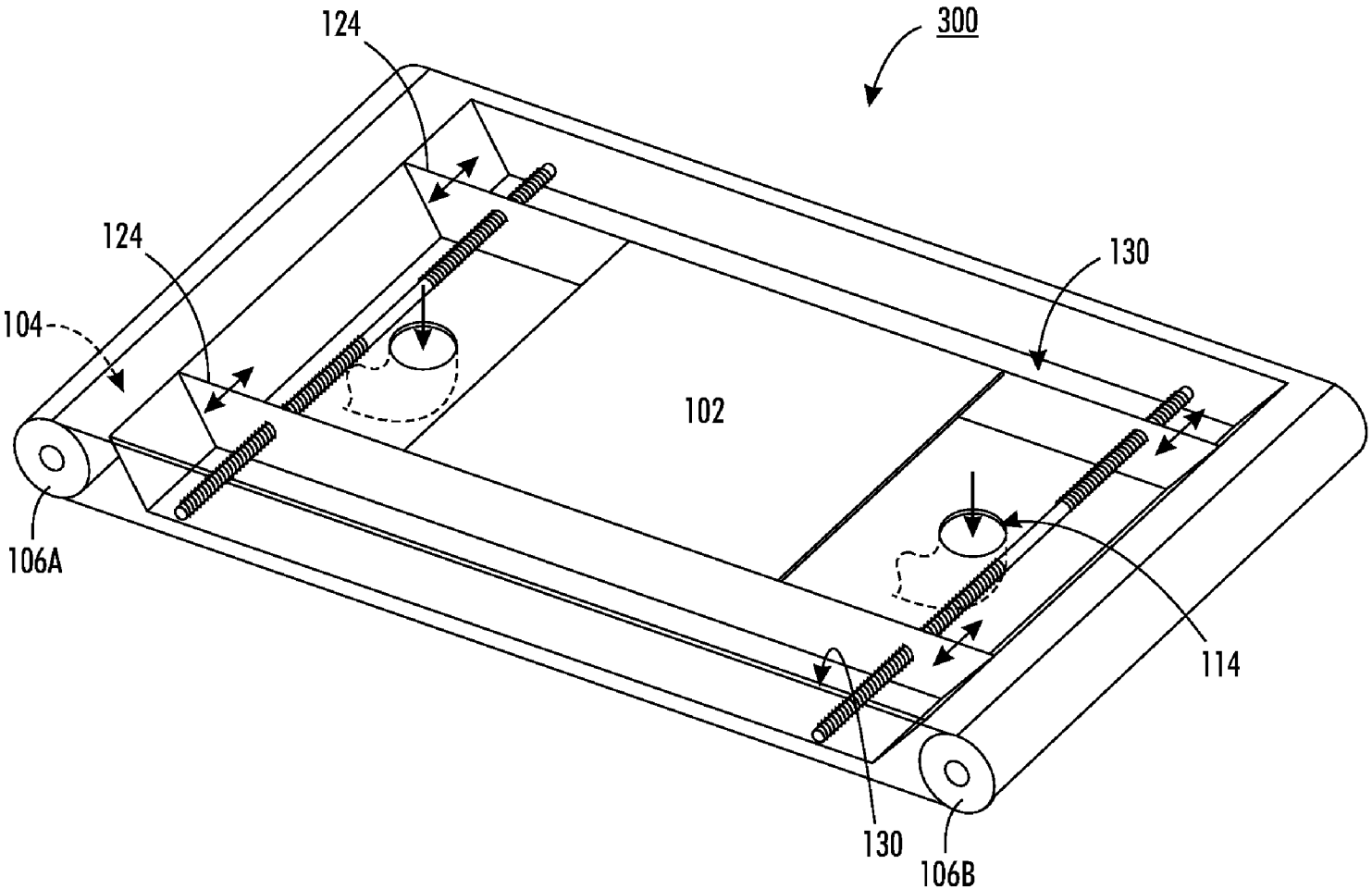
FIG. 3*b* illustrates various embodiments of a printing assembly including a movable vacuum baffle system.

FIG. 3*b* illustrates an isometric view of media hold down system 300 with the tensioned thin guides 108A and 108B, print head array 112 and adjustable connectors 120 and 122 removed to provide an unobstructed view of adjustable baffles 124. Additionally, a portion of transport surface 104 has been made transparent. In this example, adjustable baffles 124 may be moved to correspond with the outer edges (e.g., outboard and inboard) of printable medium 102. This isolates the vacuum area created by vacuum system 114. As a result, a vacuum may be created in the area defined by adjustable baffles 124, while area 130, outside the adjustable baffles, has no vacuum area created by vacuum system 114.

It should be noted that the adjustable vacuum baffle may be used in media hold down systems that do not include a tensioned thin guide system as described herein. For example, a printing device may include a set of sensors used to detect the size of a printable medium, or use information from feeding or printing systems to determine the width of the medium, and adjust the vacuum baffle to an appropriate position to handle the printable medium such that the vacuum hold down area is reduced, thereby increasing the efficiency of the vacuum hold down system.

Figure 4A:
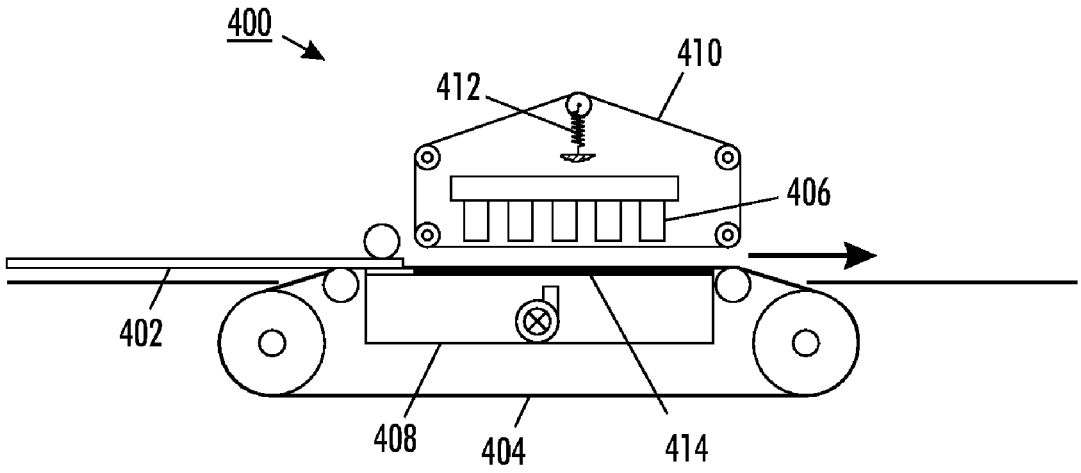
FIGS. 4*a*-4*b* illustrate various embodiments of a printable media belt transport system using magnetic clamping.
Figure 4B:
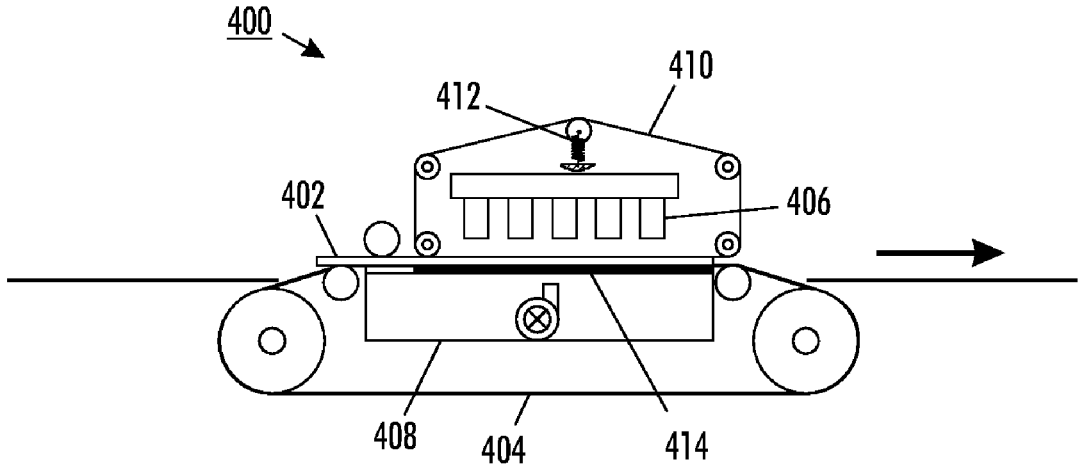

FIGS. 4*a* and 4*b* illustrates a magnetic clamping media hold system 400. In media hold down system 400, the hold down guides may be comprised of belts configured to rotate such that the portion of the belt in contact with the transport surface or the printable medium moves at the same velocity (in the process direction) as the transport surface. The guides can move vertically with respect to the transport surface to facilitate positioning in a cross-process direction. Similar to the media hold down systems discussed above, in media hold down system 400 printable medium 402 may move along transport surface 404 under print head array 406. As printable medium 402 passes under print head array 406, vacuum system 408 may be activated to assist in holding printable medium 402 flat against transport surface 404. However, to further assist vacuum system 408, an additional magnetic clamping belt or strip 410 may be used. In FIG. 4*a*, magnetic clamping strip 410 is in an upright position, away from transport surface 404, and may be held in this position by tensioning device 412. Tensioning device 412 may be a small spring or similar tensioning device.

As printable medium 402 approaches print head array 406, magnet 414 may be activated. FIG. 4*b* illustrates media hold down system 400 after magnet 414 is activated. Tension device 412 is compressed, and if magnetic clamping strip 410 is made from a suitable magnetic material, it is magnetically attracted to transport surface 404 by magnet 414. Magnet 414 may be included under transport surface 404. It should be noted that magnetic clamping strip travels in the same direction as transport surface 404, and may be powered by the friction caused by the surface of either or both of printable medium 402 and transport surface 404 as they pass under magnetic clamping strip 410. Therefore, magnetic clamping strip 410 may be constructed from an easily pliable material, such as thin steel, a fabric interwoven with metallic fibers, or a woven metal mesh such that the magnetic clamping strip is flexible enough to rotate along with transport surface 404, but also contain enough metallic material to be attracted to magnet 414.

It should also be noted that tension device 412 may be chosen such that the magnetic force exerted on magnetic clamping strip 410 by magnet 414 is great enough to overcome any tension holding the magnetic clamping strip away from transport surface 404.

Figure 5A:
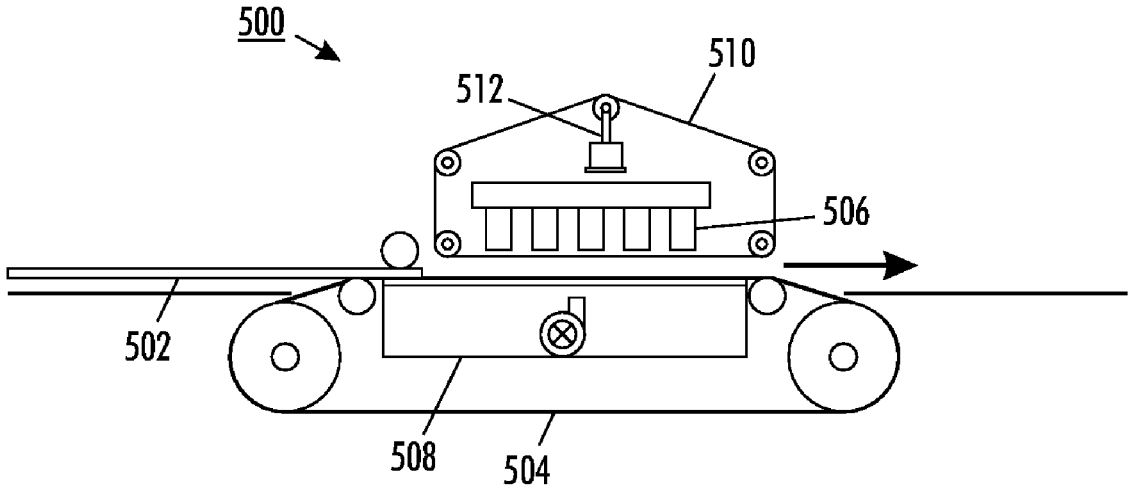
FIGS. 5*a*-5*b* illustrate various embodiments of a printable media belt transport system using vacuum clamping.
Figure 5B:
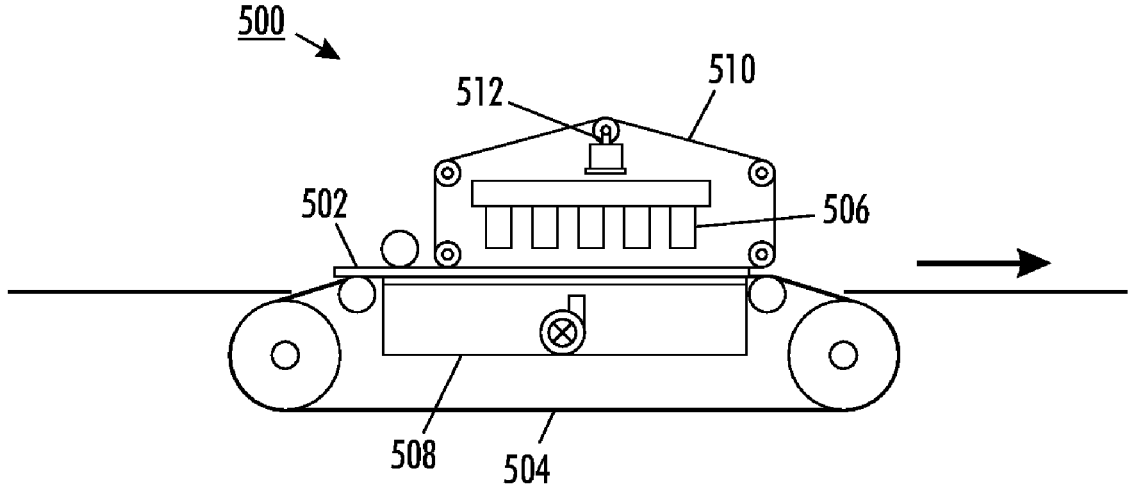

FIGS. 5*a* and 5*b* illustrate a vacuum based clamping media hold system 500. Similar to media hold down system 400, in media hold down system 500, the hold down guides may move vertically with respect to the transport surface. In media hold down system 500 printable medium 502 may move along transport surface 504 under print head array 506. As printable medium 502 passes under print head array 506, vacuum system 508 may be activated to assist in holding printable medium 502 flat against transport surface 504. However, to further assist vacuum system 508, an additional vacuum based clamping belt or strip 510 may be used. In FIG. 5*a*, vacuum based clamping strip 510 is in an upright position, away from transport surface 504, and may be held in this position by tensioning device 512. Tensioning device 512 may be a solenoid or similar tensioning device.

As printable medium 502 approaches print head array 506, tensioning device 512 may be released, thereby lowering vacuum based clamping strip 510 to transport surface 504. FIG. 5*b* illustrates media hold down system after vacuum based clamping strip 512 has been lowered. Tension device 512 is compressed, and vacuum based clamping strip 512 is attracted to transport surface 504 by the vacuum pressure created by vacuum system 508, thereby providing an additional component holding down printable medium 502. It should be noted that vacuum based clamping strip travels in the same direction as transport surface 504, and may be powered by the friction caused by the surface of either or both of printable medium 502 and transport surface 504 as they pass under vacuum based clamping strip 510. Therefore, vacuum based clamping strip 510 may be constructed from an easily pliable material, but also a material with a level of porosity such that the vacuum pressure created by vacuum system 508 is sufficient to hold down vacuum based clamping strip 510. It should be noted that the vacuum pressure exerted on the clamping strip 510 may not only be controlled by the vacuum pressure created by the vacuum system 508, but also by the width of the clamping strip and the level of porosity of the material used to make the clamping strip.

It should be noted that the above disclosed media hold-down systems may be incorporated into numerous printing devices. For example, a high speed print device capable of printing large scale printable media (e.g., 30 inches in width or greater) may utilizes the media hold down systems described herein. Similarly, a smaller scale printer used in an office environment handling mainly standard sized printable media (e.g., 8.5 inches in width) may utilize the media hold down systems described herein as well. The media hold-down systems described herein may also be used in printing systems that require a relatively long print zone, such as those that utilize multiple staggered arrays of ink jet print heads.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A printing system, the system comprising:

a print head array configured to print ink onto a printable medium;

a transport surface positioned adjacent to the print head array and configured to move a printable medium past the print head array; and a plurality of thin guides positioned between the transport surface and the print head array such that the plurality of thin guides holds the printable medium against the transport surface as the transport surface moves the printable medium past the print head array, the plurality of thin guides held in tension and configured to prevent edges of the printable medium from contacting the print head array as the printable medium passes under the print head array.

2. The system of claim 1, wherein a detected size and position of a printable medium is detected by at least one sensor configured to detect a size and a position of a printable medium.

3. The system of claim 2, wherein at least one thin guide is positioned in a cross-process direction relative to the print head array based upon the detected size and position of a printable medium.

4. The system of claim 1, wherein the plurality of thin guides overlap a printable medium on both an inboard edge and an outboard edge.

5. The system of claim 4, wherein the plurality of thin guides overlap the inboard edge and the outboard edge by a distance of approximately 1 to 4 millimeters.

6. The system of claim 1, wherein the plurality of thin guides are less than 0.5 millimeters in thickness.

7. The system of claim 1, wherein each thin guide includes at least one standoff positioned on the thin guide such that the surface of the thin guide is prevented from making contact with the print head array.

8. A printing system, the system comprising:

a print head array configured to print ink onto a printable medium;

a transport surface positioned adjacent to the print head array and configured to move a printable medium past the print head array; and a plurality of thin guides positioned between the transport surface and the print head array such that the plurality of thin guides holds the printable medium against the transport surface as the transport surface moves the printable medium past the print head array, the plurality of thin guides comprising moving guide belts configured to hold down the printable medium as the printable medium passes under the print head array.

9. The system of claim 8, further comprising rollers configured to move the transport surface at a particular speed and in a particular direction, wherein the rollers further move the movable guide belts by friction caused between the movable guide belts and the transport surface.

10. The system of claim 8, wherein the moving guide belts comprise at least a metallic portion.

11. The system of claim 10, further comprising a magnet configured to hold the moving guide belts against the transport surface.

12. The system of claim 8, wherein the moving guide belts overlap an inboard edge and an outboard edge of a printable medium by a distance of 1 to 4 millimeters.

13. The system of claim 8, further comprising a vacuum system configured to hold the moving guide belts against the transport surface.

14. A printable media hold-down system, the system comprising:

a transport surface positioned adjacent to a print head array for the purpose of moving the printable medium past the print head array; and a plurality of thin guides positioned between the transport surface and the print head array such that the plurality of thin guides hold the printable medium against the transport surface as the transport surface moves the printable medium past the print head array, wherein the plurality of thin guides is positioned in a cross process direction to the transport surface such that at least one thin guide overlaps at least one edge of the printable medium to prevent the printable medium from contacting the print head array, and wherein the plurality of thin guides comprise a plurality of thin members held in tension.

15. The system of claim 14, wherein the at least one thin guide positioned to overlap at least one edge of the printable medium is positioned in a cross process direction relative to the print head array based upon a detected size and position of a printable medium.

16. The system of claim 14, wherein the plurality of thin guides comprise a plurality of movable guide belts.

17. The system of claim 16, further comprising rollers configured to move the transport surface at a particular speed in a particular direction, wherein the rollers further move the movable guide belts by friction caused between the movable guide belts and the transport surface.

18. The system of claim 17, further comprising a magnet configured to hold the moving guide belts against the transport surface.

19. The system of claim 17, further comprising a vacuum system configured to hold the moving guide belts against the transport surface.

* * * * *